United States Patent [19]

Rix

[11] 4,221,248

[45] Sep. 9, 1980

[54] NAIL HOLDER

[76] Inventor: Wesley J. Rix, Rte. 1, Box 137, Yutan, Nebr. 68073

[21] Appl. No.: 897,928

[22] Filed: Apr. 19, 1978

[51] Int. Cl.[3] ..... B25C 3/00

[52] U.S. Cl. ..... 145/46

[58] Field of Search ..... 145/46

[56] References Cited

U.S. PATENT DOCUMENTS

| | | | |
|---|---|---|---|
| 337,905 | 3/1886 | Wheelock | 145/46 |
| 1,688,445 | 10/1928 | Williams | 145/46 |
| 1,715,819 | 6/1929 | Dealy | 145/46 |

FOREIGN PATENT DOCUMENTS

| | | | |
|---|---|---|---|
| 221265 | 5/1962 | Austria | 145/46 |
| 1257621 | 2/1961 | France | 145/46 |
| 243416 | 12/1946 | Switzerland | 145/46 |
| 563843 | 7/1975 | Switzerland | 145/46 |

*Primary Examiner*—Nicholas P. Godici
*Assistant Examiner*—Zatarga, J. T.
*Attorney, Agent, or Firm*—Hiram A. Sturges

[57] ABSTRACT

A nail holder having nail holding jaws mounted on levers pivoting at a position such that good leverage can be applied for gripping a nail, the undersides of the jaws providing a cavity receiving a ridge of corrugated roofing, the tool being formed in a manner for economical manufacture from materials sufficiently malleable as to withstand hammer blows, some of the levers being formed of steel bars twisted for ease of pivotal attachment.

4 Claims, 4 Drawing Figures

NAIL HOLDER

BACKGROUND OF THE INVENTION

During the nailing of corrugated roofing sheets onto a roof, nails frequently glance away from the convex ridge, rather than driving straight through the ridge as is desirable.

When a nail glances in this way it can even penetrate the metal in a valley between the ridges where rain will cause leaking.

A glancing nail can cause the hammer to strike a person's thumb, resulting in a very badly bruised "black" thumb.

Even though corrugated roofing has been popular for the greater part of a century, no tool to my knowledge has ever been marketed for solving this problem. I am aware of a proposal made in U.S. Pat. No. 1,688,445, issued to I. N. Williams on Oct. 23, 1928, titled "NAIL HOLDER". In this patent the levers were shaped in a curved manner and the jaws were of one piece with the respective levers, so that the only way that would be suggested for making the tool would be to make it by casting the parts. However, cast parts will break quickly when hit with a hammer as would often occur. In my opinion, this is probably a reason why I have not seen the tool of this patent on the market.

It is an object of this invention to provide a nail holding tool, the under surfaces of which are adapted to snugly fit corrugation, ridges, but having the features that the tool is adapted to economical manufacture from materials that can withstand hammer blows, rather than having the problem of being cracked by hammer blows as in the case of cast metal.

I conceive for economical manufacture that the levers of a nail holder could be made of steel bar stock which is economically available and that the forward ends of the levers could be twisted into horizontal planar positions for effective pivotal attachment of the levers together, while yet permitting a bending of the levers transversely of their width in positions for achieving a desired shape and supporting nail holding jaws. Such steel could receive a hammer blow and the blow would tend to be withstood, because the blow would hit the steel bar stock edgewise, although I prefer that the jaws protrude above the levers so that the jaws receive all normal and accurate hammer blows.

I propose that the jaws themselves be made of malleable material, capable of withstanding hammer blows, and I have found that lead is a good material for this purpose. Lead can be cast to a desired shape and yet is malleable, which cannot be said for cast iron.

A further object of this invention is to provide jaws which can be easily held in place by metal screws for economical fabrication.

A further objective is to provide the concept of attaching the jaws to the levers in a manner such that when a vertical set of nail receiving notches in the jaws are in upright nailing position, then the handle ends of the levers will be spaced from adjacent parts of the roofing for accommodating the fingers between the levers and the roofing.

A further object is to provide a nail holder that is suitable for holding nails that are being driven into concrete because the nails are firmly held by good leverage, and because the jaws are solid without openings therethrough, whereby chips of concrete cannot fly up from the point of the nail through any openings in the jaws endangering the eyes of a workman.

SUMMARY OF THE INVENTION

The main feature of this invention is to provide a nail holder having right and left elongated levers pivotally attached together at one end for pivoting about an axis, right and left jaws attached to respective right and left levers and facing each other and having nail-gripping surfaces respectively disposed in positions for gripping a nail at times when said levers are in positions for nail-gripping, the undersides of the jaws having grooves which together form a cavity adapted to receive a ridge of corrugated roofing, the jaws having notches therein for receiving the opposite sides of a nail for firmly holding the nail straight and supporting the nail so that it does not become bent while being driven, the jaws being disposed near the attached ends of the levers.

A further feature is an economy of construction accomplished by using flat pieces of material for the levers with the levers being twisted so as to have horizontal forward portions for ease of attachment, yet vertical portions for ease of mounting of the jaws thereon.

Another feature is to provide a nail holder, the forward ends of the levers and the jaws of which are formed of material sufficiently malleable and non-brittle as to withstand hammer blows like steel, the jaws preferably being of lead for ease of application and the ability to withstand hammer blows without cracking and also without damaging the head of the hammer, since hammer heads can be chipped and are very expensive.

DESCRIPTION OF THE PREFERRED EMBODIMENT

Figure 1:
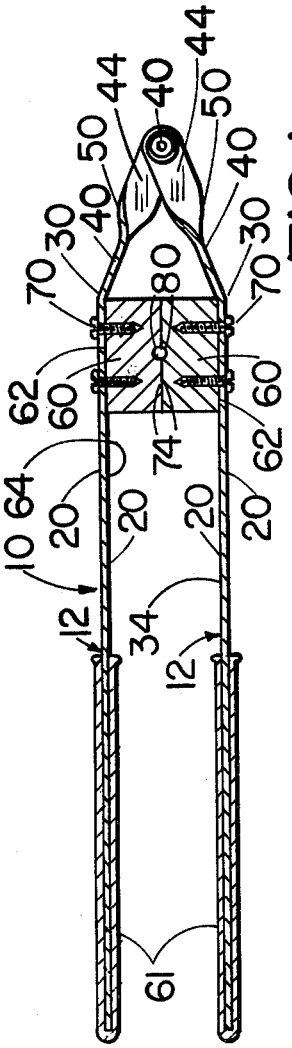
FIG. 1 is a top plan view of the nail holder of this invention shown in a jaws closed position with handle covering materials thereof shown with uppermost portions broken away and the remainder shown in section.

The nail holder of this invention is generally indicated at 10 in FIG. 1, and comprises left and right levers 12, which are formed of steel bar stock, having planar vertical sides 20 and along most of the length of each lever 12, although adjacent but spaced from the forward end of each lever 12 the lever is bent at 30 toward a pivot axis 40 at obtuse angle inclination with respect to the respective straight main portion 34 of the lever, such inclining portions being seen at 40 and having at their forward ends terminal portions 44, which are disposed in horizontal planes because the bar stock material of the levers 12 is twisted 90° at 50 between the flat inclining portions 40 and the forward horizontal portions 44.

The forward horizontal portions 44 are secured together by any suitable security means such as a rivet 50 for pivoting about the axis 40.

The rearward ends of the levers 12 can be provided with suitable covering 61, shown in cross section in FIG. 1.

Between the forward ends of the straight portions 20 of the levers 12 left and right jaws 60 are disposed, the jaws 60 having vertical planar flat outer edges 62 abutting inner sides 64 of the levers and to which they are secured by metal screws 70 extending through the apertured levers 12 and into the jaws 60 which are preferably formed of malleable material such as lead.

Figure 3:
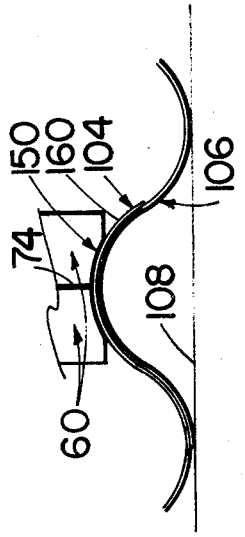
FIG. 3 is a view of two lapped pieces of corrugated roofing material shown as seen from an edge and parallel with the straight parallel ridges thereof, lowermost parts of the jaws of the nail holder of this invention being shown in position above a ridge preparatory to the driving of a nail, other portions of the nail not being shown.
Figure 2:
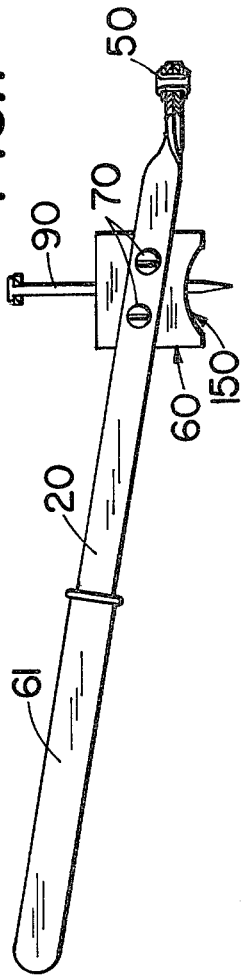
FIG. 2 is a side elevation of the nail holder of this invention shown in nail-gripping position and nail-driving position with a nail being shown therein.

The inner edges of the jaws 60 are preferably flat and are seen at 74, but with the exception that they are provided with vertical nail receiving notches 80 which cooperate by being disposed opposite each other to form, in effect, an elongated cylindrical opening to which a nail can be received, as shown by the nail 90 of FIG. 2, preparatory to the driving of the nail through corrugated roofing materials such as an upper layer of corrugated roofing 104, and a lower layer of corrugated roofing 106, shown in FIG. 3. The under surfaces of the jaws 60 are provided with grooves 140, extending from right to left completely thereunder, and together forming a cavity 150 at times when the jaws 60 are substantially against one another. The cavity 150 is of a concave curved shape, extending from left to right, and is adapted to be snugly received against a complimentary shaped convex upper surface 160 of a ridge of the roofing material 104, as best seen in FIG. 3, whereby the nail 90 of FIG. 2 can be driven down through the opening 80, best seen in FIG. 1, while the tool is held from sliding off of the ridge 160 by the cavity 150, which latter lapse across substantial areas on both sides of the crest of the ridge 160.

Referring to FIG. 2, it will be seen that the elongated straight lever portions 20 extend at an obtuse angle with respect to the horizontal at times when the tool is held in a position such that its nail groove 80 is vertical. This is so the fingers of an operator can extend around the handle portion under the covering 61 without engaging adjacent parts of the corrugated roofing materials.

Figure 4:
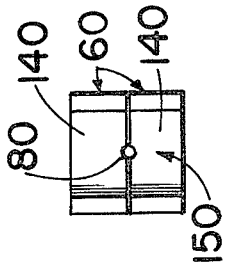
FIG. 4 is a bottom plan view of the jaws of the nail holder shown in jaws-closed position.

The jaws, as best seen in FIGS. 1 and 4, have a horizontal dimension as measured in a direction transverse to the length of the levers which dimension is more than the corresponding transverse dimension of the respective lever by a multiple of at least 2, as shown, and even by a multiple of at least 4, as shown.

I claim:

1. A nail holder having right and left elongated levers, means attaching said levers pivotally together at their forward end for rotation about an axis, said levers being disposed alongside each other and being spaced apart with respect to each other in directions transverse to the elongation of said levers, right and left nail-gripping jaws each mounted on a respective one of said right and left levers, said jaws having opposed nail-gripping surfaces adapted to grip a nail therebetween when said jaws are held in a gripping position, said jaw surfaces being disposed in positions between said axis and the opposite ends of said levers and being disposed much closer to said axis than to said other ends of said levers, said jaws each having a horizontal dimension as measured in a direction transverse to the length of said levers which dimension is more than the corresponding transverse dimension of the respective lever by a multiple of at least 2, said nail gripping surfaces forming a nail groove when said jaws are held in said gripping position, said nail groove being vertical and parallel to said axis, said levers extending at an acute angle upwardly with respect to said axis, said forward lever ends each being twisted 90° so that their forward ends are horizontal, said levers each having the same transverse cross-sectional shape substantially from their rearward ends forwardly to said jaws so as to be manufacturable from bar-stock, and the jaws protruding below said levers and defining a concave recess perpendicular to said nail groove and transversely extending with respect to said levers, said recess being for placement over the crest of corrugated sheet metal.

2. The nail holder of claim 1 in which said jaws protrude both above and below said levers.

3. The nail holder of claim 1 having said jaws being substantially made of lead.

4. The nail holder of claim 1 having said multiple being at least 4.

* * * * *